US005242128A

United States Patent [19]

Polnik et al.

[11] Patent Number: 5,242,128

[45] Date of Patent: Sep. 7, 1993

[54] DEVICE FOR WINDING A THREAD ONTO A SPOOL

[75] Inventors: Peter Polnik, Viersen; Christel Achmus, Bremen, both of Fed. Rep. of Germany

[73] Assignee: Palitex Project-Company GmbH, Krefeld, Fed. Rep. of Germany

[21] Appl. No.: 949,093

[22] Filed: Sep. 21, 1992

[30] Foreign Application Priority Data

Sep. 21, 1991 [DE] Fed. Rep. of Germany ..... 4131450

[51] Int. Cl.[5] ..... B65H 54/02; B65H 54/28

[52] U.S. Cl. ..... 242/18 PW; 242/43 R

[58] Field of Search ..... 242/18 PW, 18 R, 18 DD, 242/18 A, 43 R, 158 R, 158.3

[56] References Cited

U.S. PATENT DOCUMENTS 3,347,490 10/1967 Browning ..... 242/158.3

FOREIGN PATENT DOCUMENTS 2312609 3/1973 Fed. Rep. of Germany .
3939595 11/1989 Fed. Rep. of Germany .
4034482 10/1990 Fed. Rep. of Germany .

*Primary Examiner*—Stanley N. Gilreath

*Attorney, Agent, or Firm*—Robert W. Becker & Associates

[57] ABSTRACT

A device for winding a thread onto a spool body is comprised of a main thread traversing guide having a stroke a and a compensating thread traversing guide with a stroke a/2. The thread is guided from a thread feeding device via a stationary deflecting guide roller, a third deflecting guide roller which corresponds to the compensating thread traversing guide, and a second deflecting guide roller which is connected to the main thread traversing guide. The threading device is comprised of a device for clamping the thread to one end of the spool body, a thread guide plate, the curved upper edge of which serves to transport the thread past the stationary deflecting guide roller onto a thread guide edge and to a thread catch. The thread is threaded into the second deflecting guide roller by a first follower connected to the main thread traversing guide. With a second follower connected to the main thread traversing guide the thread is removed from the thread catch during the return stroke and is threaded into the stationary guide roller. A thread loop is conveyed with the second follower past the third deflecting guide roller corresponding to the compensating thread traversing guide and after a further return stroke is threaded into this third deflecting guide roller by a third follower.

12 Claims, 7 Drawing Sheets

DEVICE FOR WINDING A THREAD ONTO A SPOOL

BACKGROUND OF THE INVENTION

The present invention relates to a device for winding a thread onto a spool body. The device comprises: a spool holder for the spool body comprising a device for clamping the thread end to the spool body; a drive unit for driving the spool body; a thread feeding device coordinated with the spool body; a stationary first thread deflecting device connected downstream of the thread feeding device and located opposite the longitudinal center of the spool; a main thread traversing guide comprising a second thread deflecting device, the second thread deflecting device positioned between the first thread deflecting device and the spool body, the main thread traversing guide reciprocating along a first traversing path parallel to a center axis of the spool body with a predetermined first traversing stroke corresponding essentially to the length of the spool body; a compensating thread traversing guide in the form of a third thread deflecting device, positioned between the first thread deflecting device and the main thread traversing guide, the third thread deflecting device reciprocating along a second traversing path parallel to the first traversing path of the main thread traversing guide, the second traversing path located between the longitudinal center of the spool body and one end of the spool body, the second traversing path having a predetermined second traversing stroke corresponding essentially to half the first traversing stroke, wherein the first, the second, and the third thread deflecting devices are essentially arranged in a common plane, and wherein, for winding the thread onto the spool body, the thread is guided from the thread feeding device via the first, the second, and the third thread deflecting devices and via the main thread traversing guide to the spool body.

Devices of the aforementioned kind are essentially known and for example described in German Offenlegungsschrift 39 39 595 and U.S. Pat. No. 3,347,490.

Such devices are employed with textile machines, for example, double twisting machines, for winding the threads delivered by the textile machines onto, for example, cross spools.

The double traversing method employed herewith serves to achieve a length and tension compensation of the thread within the so-called traversing triangle before the thread actually reaches the periphery of the spool body.

In the double traversing method the thread is guided over at least three thread deflecting devices and the threading or insertion step during operation of the device is difficult.

In devices for winding a thread onto a spool body by the single traversing method, it is known to achieve the threading of the thread end coming from the thread feeding device by a device for clamping the thread end to one end of the spool body. The thread traversing guide is designed such that the thread is automatically threaded during reciprocating of the thread traversing guide. However, this method is faced with considerable difficulties when applied to double transversing processes with a plurality of thread deflecting devices.

It is therefore a object of the present invention to provide a device for winding a thread onto a spool body of the aforementioned kind with which, after clamping the thread end to one end of the spool body, an automatic threading process is initiated upon starting of the winding process due to the driven spool body together with the main thread traversing guide and the compensating thread traversing guide, whereby at the end of the threading step the thread is guided from the thread feeding device via the first thread deflecting device, the third thread deflecting, and the second thread deflecting device and via the main thread traversing guide to the spool body.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
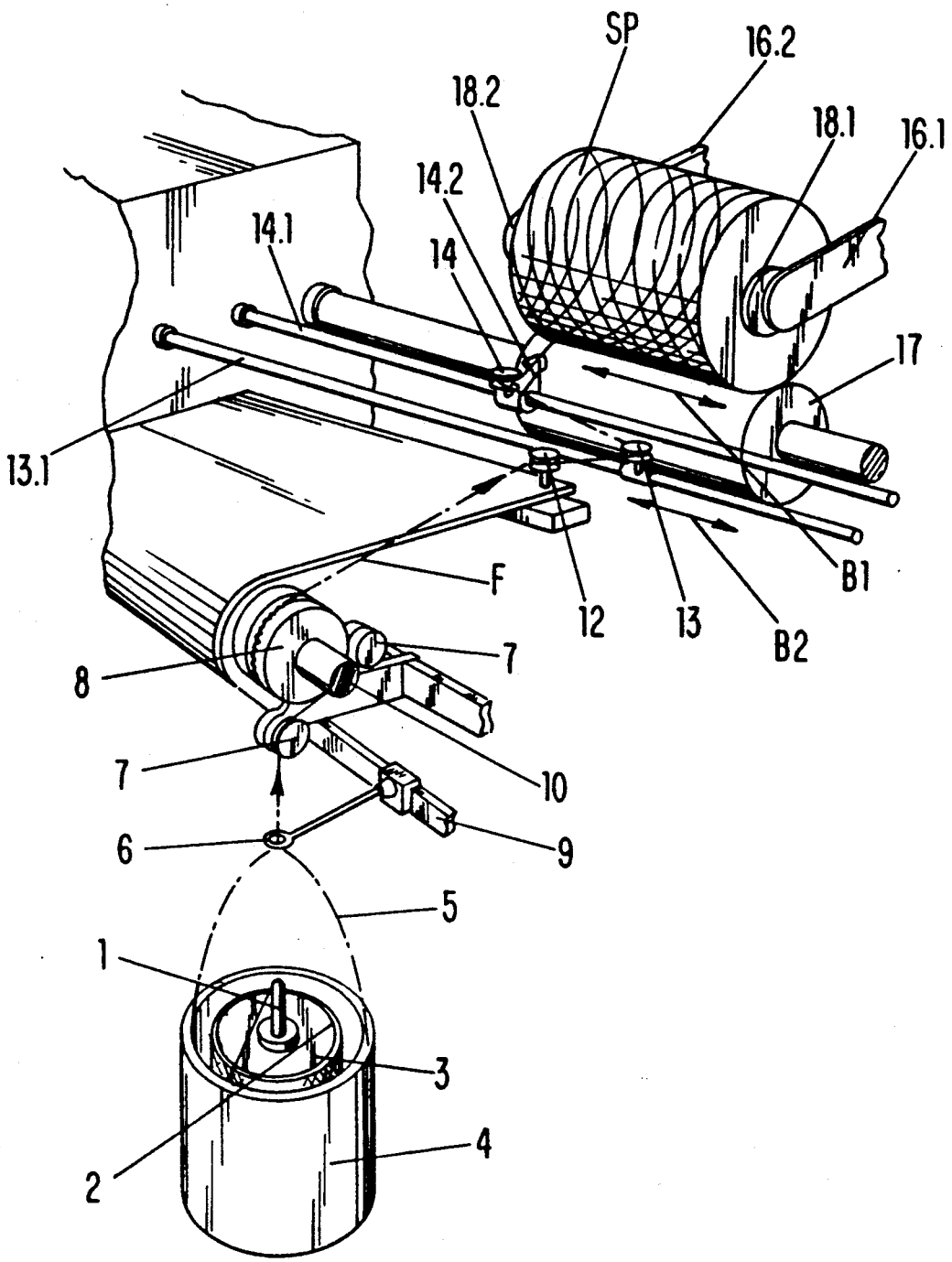
FIG-1 PRIOR ART
FIG. 1 is a schematic perspective representation of a part of a commonly used device for winding a thread onto a spool body by the double traversing method, shown in cooperation with a double twisting machine spindle.

The inventive device for winding a thread onto a spool body is primarily characterized by:

A spool holder for the spool body comprising a device for clamping the end of the thread to a first end of the spool body;

A drive unit for driving the spool body;

A thread feeding device coordinated with the spool body;

A stationary first thread deflecting device connected downstream of the thread feeding device and located opposite the longitudinal center of the spool body;

A main thread traversing guide comprising a second thread deflecting device, the second thread deflecting device positioned between the first thread deflecting device and the spool body the main thread traversing guide reciprocating along a first traversing path parallel to a center axis of the spool body with a predetermined first traversing stroke corresponding essentially to the length of the spool body;

A compensating thread traversing guide in the form of a third thread deflecting device positioned between the first thread deflecting device and the main thread traversing guide, the third thread deflecting device reciprocating along a second traversing path parallel to the first traversing path of the main thread traversing guide, the second traversing path located between the longitudinal center of the spool body and the first end of the spool body, the second traversing path having a predetermined second traversing stroke corresponding essentially to half the first traversing stroke, wherein the first, the second, and the third thread deflecting devices are essentially arranged in a common plane, and wherein, for winding the thread onto the spool body, the thread is guided from the thread feeding device via the first, the second, and the third thread deflecting devices and via the main thread traversing guide to the spool body;

A thread guide plate connected between the thread feeding device and the first thread deflecting device, the thread guide plate having a curved upper edge on which the thread glides during an initial threading step, the curved upper edge having a first and a second end and extending parallel to the first traversing path of the main thread traversing guide at an elevation above the first thread deflecting device, with the first end positioned opposite the device for clamping the thread and with the second end positioned opposite the first thread deflecting device;

A thread guide edge connected between the second and the third thread deflecting devices and extending parallel to a plane of the first traversing path of the main thread traversing guide, the thread guide edge ascending from a point below the second end of the curved upper edge in a direction toward the second end of the spool body and ending in a recessed thread catch, the thread catch positioned between the first thread deflecting device and the end position of the first traversing path in the area of second end of the spool body;

A first follower connected to the second thread deflecting device comprised of a finger extending in the direction of the first traversing path and pointing toward the second end of the spool body, the first follower having sliding edges for the thread at the top side and at the bottom side of the first follower that extend upwardly in the direction of the free end of the first follower, the sliding edge at the bottom side of the follower having a transition into the second thread deflecting device;

A second follower connected to the second thread deflecting device, the second follower facing the first end of the spool body, the second follower comprising a holder that during its course of movement traverses the thread guide edge and has a hook that, in the direction of movement, is open toward the first end of the spool body, wherein the distance between the hook and the second thread deflecting device is smaller than the distance between the thread catch and the end position of the first traversing path in the area of the second end of the spool body and is greater than the distance between the end position of the first traversing path in the area of the first end of the spool body and the end position of the second traversing path in the area of the first end of the spool body; and A third follower connected to the third thread deflecting device, the third follower in the form of a finger extending toward the first end of the spool body in the direction of the second traversing path, the third follower having sliding edges for the thread at the top side and at the bottom side thereof that extend upwardly in the direction of the free end of the third follower, the sliding edge at the bottom side having a transition into the third thread deflecting device, wherein the free end of the third follower is positioned essentially in the plane of movement of the hook.

Preferably, the device further comprises a thread guiding roller connected to the first end of the curved upper edge of the thread guide plate, the thread guiding roller having a threaded outer mantle surface. Expediently, the device further comprises a thread depressor connected in front of the thread guide plate when viewed in the direction of movement of the thread.

It is advantageous to provide a cover plate for covering the area between the thread feeding device and the main thread traversing guide above the first, the second, and the third thread deflecting devices, with the area of the thread guiding roller and the thread depressor remaining uncovered. Preferably, the cover plate is made of transparent material.

Expediently, the curved upper edge of the thread guide plate is downwardly slanted from the thread guiding roller to the second end of the curved upper edge.

Advantageously, the spool holder comprises a spring-loaded frame and rotatably supported centering disks. The first one of the centering disks is preferably the device for clamping the end of the thread, whereby the first centering disk is pivotably supported at the frame. The spool body is held in an initial position within the frame by the spring load and is slidable against the spring load so that a gap results between an end face of the spool body facing the first centering disk and the first centering disk. For clamping the end of the thread, the end of the thread is placed into the ga and the spool body is moved back into the initial position so that the end of the thread is clamped between the spool body and the centering disk.

Preferably, at least one of the first, the second, and the third thread deflecting devices are deflecting guide rollers. At least one of the deflecting guide rollers has a thread catching device shaped like an open bill. Advantageously the first follower and the third follower are components of the thread catching devices.

The device preferably further comprises a guiding plate arranged in a plane parallel to the plane of movement of the main thread traversing guide with the upper edge of the guiding plate forming the thread guide edge and the thread catch. The device also preferably further comprises a guide rod having connected thereto the main thread traversing guide and wherein the holder of the second follower is an essentially U-shaped plate open in a downward direction. The plane of the guiding plate is positioned between the legs of the U-shaped plate. One of the legs of the U-shaped plate is connected to the guide rod with the other leg of the U-shaped plate, at a side thereof facing the second thread deflecting device, having a recessed sliding edge and, at a side thereof facing away from the second thread deflecting device, having the aforementioned hook at its lower end.

The basic principle of the present invention is that the thread which is clamped at one end of the spool body is first moved in a direction parallel to the traversing strokes of the two thread traversing guides at a position between the thread feeding device and the first thread deflecting device to such an extent that it passes by the first stationary thread deflecting device. This movement is at least in its second part initiated by a first follower connected to the second thread deflecting device which is also connected to the main thread traversing guide, whereby the thread is threaded into the second thread deflecting device. The thread is then engaged by a second follower which is connected to the main thread traversing guide and is reciprocated. During this movement it is first threaded into the first thread deflecting device and the thread loop which is generated between the first and the second thread deflecting devices is guided past the third thread deflecting device which is connected to the compensating thread traversing guide. After a further change of the direction of movement, the thread loop is released from the second follower and is engaged by a third follower which is arranged at the third thread deflecting device and is then threaded into the third thread deflecting device connected to the compensating thread traversing guide. Thus, the thread has been guided over all three thread deflecting devices and the threading process is terminated. Details of the components of the device which collaborate in the above described steps will be explained in detail infra with the aid of a specific embodiment.

The clamping of the end of the thread at one end of the spool body for initiating the threading process may be performed manually with a device as described for example in German Offenlegungsschrift 23 12 609, or automatically according to a method and a device disclosed in German Offenlegungsschrift 40 34 482.

The thread deflecting devices may be in the form of deflecting guide rollers. Because of the minimal distances of the components traversing relative to one another it is expedient with respect to the safety considerations to provide a cover plate within the area between the thread feeding device and the main thread traversing guide above the thread deflecting devices. The cover plate may be comprised of, for example, transparent material in order to allow a visual control of the operation of the device.

DESCRIPTION OF PREFERRED EMBODIMENTS

The present invention will now be described in detail with the aid of several specific embodiments utilizing FIGS. 1 through 10.

In the following the operation of a common device for winding a thread onto a spool body according to the double traversing method will be explained with the aid of FIGS. 1 and 2. The device of FIG. 1 is coordinated with a double twisting machine spindle, with a thread inlet tube 1, a spool cup 2 with feeding spool 3 inserted therein, as well as a balloon 4 of the double twisting machine spindle being represented schematically in the drawing. The thread removed from the feeding spool 3 passes through the thread inlet tube 1 and the commonly employed thread storage disk, not represented in the drawing, and forms a thread balloon 5 during removal from the double twisting machine spindle. The thread balloon 5 has its upper limitation at the balloon guide 6 from which the thread F is guided via guide rollers 7 to the feed roller 8 which is connected to a shaft that is externally driven. The guide rollers 7 as well as the balloon guide 6 are supported at a support 9 of the machine frame. The feed roller 8 corresponds to the thread feeding device for the actual winding device.

Downstream of the feed roller 8 the thread is guided via a first thread deflecting device in the form of a deflecting guide roller 12 which is fixedly connected to the machine frame. From there the thread is guided to a second thread deflecting device in the form of a deflecting guide roller 14 which is connected to the main thread traversing guide 14.2. Between the first deflecting guiding roller 12 and the second deflecting guide roller 14 the thread is also guided via a third thread deflecting device in the form of a deflecting guide roller 13 which corresponds to the compensating thread traversing guide. From the main thread traversing guide 14.2 the thread is then guided onto the spool SP which is wound onto a spool body 15 which is not represented in the drawing FIG. 1.

The spool body 15 is held within a spring-loaded frame between frame arms 16.1 and 16.2 via centering disks 18.1 and 18.2. The spool body 15 is driven by an externally driven frictional drive roller 17.

The main thread traversing guide 14.2 is connected to a reciprocating guide rod 14.1 and the compensating thread traversing guide represented by the third deflecting guide roller 13 is connected a reciprocating guide rod 13.1. The traversing path of the main thread traversing guide 14.2 is indicated with reference numeral B1 in FIG. 1, and the traversing path of the compensating thread traversing guide 13 is indicated with reference numeral B2.

Figure 2:
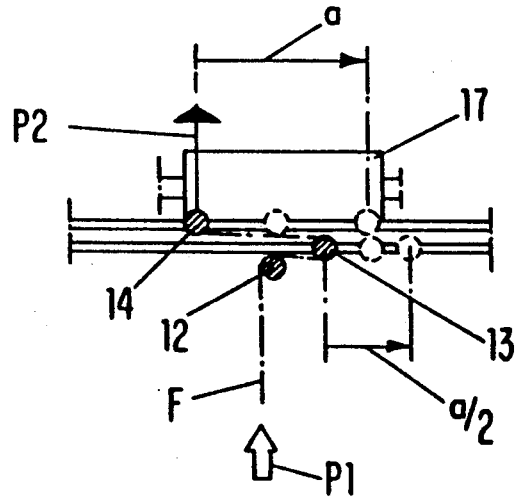
FIG-2 PRIOR ART
FIG. 2 is a schematic representation of the movements of the main thread traversing guide and the compensating thread traversing guide for a device according to FIG. 1 without a threading device.

The course of movements of such a device operated by the double traversing method may be taken from FIG. 2.

FIG. 2 shows the positions of the three thread deflecting guide rollers for three different positions of the main thread traversing guide and of the compensating thread traversing guide. The left end position of the second deflecting guide roller 14 and of the third deflecting guide roller 13 together with the stationary position of the deflecting guide roller 12 as shown in solid lines. The dashed lines represent a median position as well as the right end position of the deflecting guide rollers 14 and 13. It is known that for a double traversing method the following rule applies: The main thread traversing guide performs a full stroke a while during the same time period the compensating thread traversing guide performs half the stroke a/2. The full stroke a corresponds essentially to the length of the spool SP and the traversing path, respectively, the traversing stroke of the compensating thread traversing guide with the stroke a/2 occurs parallel to the traversing path of the main thread traversing guide within an area essentially between the longitudinal center and the end of the spool body. It is possible that the right end position, as shown in FIG. 2, of the third deflecting guide roller 13 is located outside the limits of t he spool body 15. The thread runs in the direction of arrow P1 to the first deflecting guide roller 12 and is guided in the direction of arrow P2 via the second deflecting guide roller 14 and the main thread traversing guide, not represented in the drawing, to the spool SP. It may be taken from FIG. 2 that the length of the thread between the first deflecting guide roller 12 and the second deflecting guide roller 14 in all positions of the main thread traversing guide and of the compensating thread traversing guide is identical.

Figure 3:
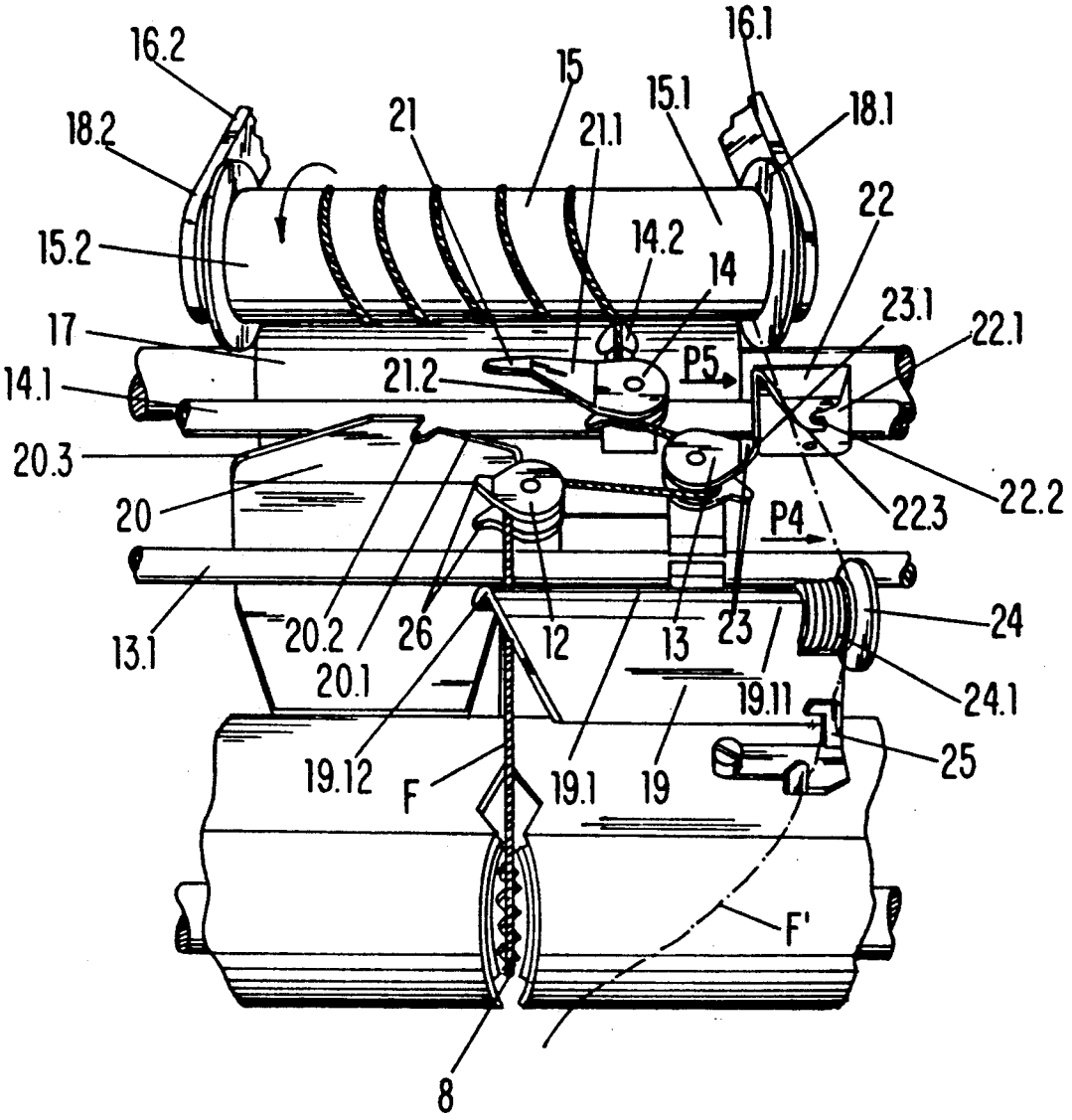
FIG. 3 is a perspective representation of the area between the thread feeding device and the spool body of a device for winding a thread onto a spool body with a threading device.

With the aid of FIG. 3 the basic construction of a winding device according to FIG. 1 with a threading device will be explained in the following. In FIG. 3 the device is shown in the threaded stage in which the thread F, originating from the feed roller 8, is guided about the first deflecting guide roller 12, then about the third deflecting guide roller 13 and finally about the second deflecting guide roller 14 from where it is guided via the main thread traversing guide 14.2 to the spool body 15. In a dash-dotted line the thread F' as positioned before the threading process is indicated.

In the following the individual components of the threading device will be explained.

Figure 4:
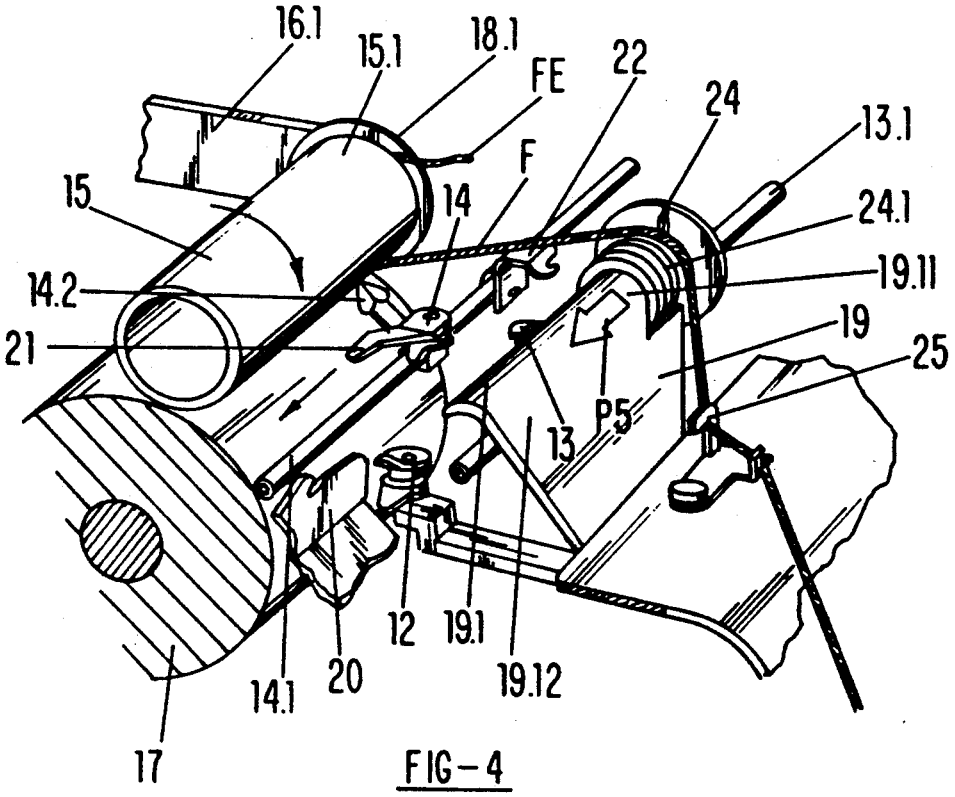
FIGS. 4–9 show in perspective representations portions of the device according to FIG. 3 in various phases of the threading process.

The device for clamping the thread is located at the right end of the spool body 15, see FIG. 3, and is thus positioned opposite the traversing path of the compensating thread traversing guide, i.e. opposite the third deflecting guide roller 13. The right end 15.1 of the spool body 15 in FIG. 3 in the following is called the first end of the spool body 15. The device for clamping the thread is known per se and will not be explained in detail. It is sufficient to note that the end of the thread, as can be seen for example in FIG. 4, is clamped between the centering disk 18.1 and the first end 15.1 of the spool body 15.

Between the feed roller 8 and the first deflecting guide roller 12 a stationary thread guide plate 19 is arranged opposite the first end 15.1 of the spool body 15 essentially in the right half of FIG. 3. This thread guide plate 19 is provided with a curved upper edge 19.1 which extends essentially parallel to the traversing paths P4 and P5 of the two deflecting guide rollers 13 and 14 and which descends at a slight angle from the right to the left. At the right outer end 19.11 of the curved upper edge 19.1 a thread guiding roller 24 is arranged which is positioned opposite to the first end 15.1 of the spool body 15 and which is provided with a threaded outer mantle surface 24.1. The left inwardly oriented end 19.12 of the curved upper edge 19.1 of the thread guide plate 19 is positioned at an elevation above the first deflecting guide roller 12, and, as can be seen in FIG. 3, is slightly displaced to the left, that is in direction to the second end 15.2 of the spool body 15, relative to the first deflecting guide roller 12.

At the forward end of the thread guide plate 19 a hook-shaped thread depressor 25 is arranged within the area of the outermost end 19.11 of the curved upper edge 19.1.

As can be seen also in FIG. 3, in the area between the first deflecting guide roller 12 and the second end 15.2 of the spool body 15 a guiding plate 20 is arranged such that its upper edge is positioned in a plane which is parallel to the traversing path of the second and the third deflecting guide rollers 14 and 13. This upper edge is provided with a first thread guide edge 20.1 which extends at a positive incline from an area below the innermost end 19.12 of the curved upper edge 19.1 of the thread guide plate 19 in direction toward the second end 15.2 of the spool body 15 and ends in a thread catch 20.2. This thread catch 20.2 is arranged such that it is positioned between the first deflecting guide roller 12 and the end position of the traversing path of the second deflecting guide roller 14 within the area of the second end 15.2 of the spool body 15. At the upper edge of the guiding plate 20 a second thread guide edge 20.3 is arranged which extends from a point within an area opposite to the second end 15.2 of the spool body 15, direction to the first end 15.1 of the spool body 15, to the thread catch 20.2. The second thread guide edge ascends over a portion of its length.

Furthermore, the second deflecting guide roller 14 is provided with a first follower 21 which is provided in the form of a finger extending in the direction of the traversing path towards the second end 15.2 of the spool body 15. The finger has sliding edges for the thread at the top side 21.2 and at the bottom side 21.2 that extend upwardly in the direction of the free end of the finger. The sliding edge 21.2 at the bottom side of the finger has a transition into the second thread deflecting device, i e., deflecting guide roller 14.

A second follower 22 is arranged on the guide rod 14.1 and is therefore indirectly connected to the second deflecting guide roller 14. The second follower 22 extends in the direction toward the first end 15.1 of the spool body 15. The second follower 22 comprises a holder 22.1 which is essentially in the form of a U-shaped plate opening in a downward direction. The plane of the guiding plate 20 extends between the legs of the U-shaped plate so that the holder 22.1 along its traversing path traverses the thread guide edge 20.1. One leg of the holder 22.1 is connected to the rod 14.1 while the other leg is provided with a recessed sliding edge 22.3 at a side which is facing the second deflecting guide roller 14. At the bottom end of this leg, at the side facing away from the second deflecting roller 14, a hook 22.2 is provided which is open in the direction of movement toward the first end 15.1 of the spool body 15.

The special conditions to be observed for arranging the second follower 22 relative to the second deflecting guide roller 14 will be explained with the aid of FIG. *2a*. FIG. *2a* shows the following additional reference numerals:

EP1: End position of the traversing path of the second deflecting guide roller 14 at the side of the first end 15.1 of the spool body 15:

EP2: End position of the traversing path of the second deflecting guide roller 14 at the side of the second end 15.2 of the spool body 15;

EP3: End position of the traversing path of the third deflecting guide roller 13 at the side of the first end 15.1 of the spool body 15;

EP4: Second end position of the traversing path of the third deflecting guide roller 13;

X: Distance between hook 22.2 and the second deflecting guide roller 14;

Y: Distance between end position EP2 and the thread catch 20.2; and

Z: Distance between end position EP1 and end position EP3 in the direction of movement.

In order to guarantee a reliable functioning of the second follower 22 during the threading process, the distance X between the hook 22.2 and the second deflecting guide roller 14 must be smaller than the distance Y between the thread catch 20.2 and the end position EP2 of the traversing path of the second deflecting guide roller 14, but must be greater than the distance Z between the end position EP1 of the traversing path of the second deflecting guide roller 14 and the end position EP3 of the traversing path of the third deflecting guide roller 13.

At the third deflecting guide roller 13 a third follower 23 is arranged. This follower 23 is a component of a thread catching device which is provided at the third deflecting guide roller 13 and which is shaped like an open bill. The third follower 23 comprises a finger 23.1 which is connected to the upper side of the third deflecting guide roller 13 and which extends in the direction of the traversing path toward the first end 15.1 of the spool body 15. The finger 23.1 is provided with sliding edges at the top and bottom side which ascend towards the free end of the finger. This third follower 23 has its free end essentially positioned within the plane of the traversing path of the hook 22.2. The sliding edge at the bottom side has a transition into the third deflecting guide roller 13.

With the aid of FIGS. *2a* to 9 the threading step of the aforedescribed threading device will be explained.

Figure 5:
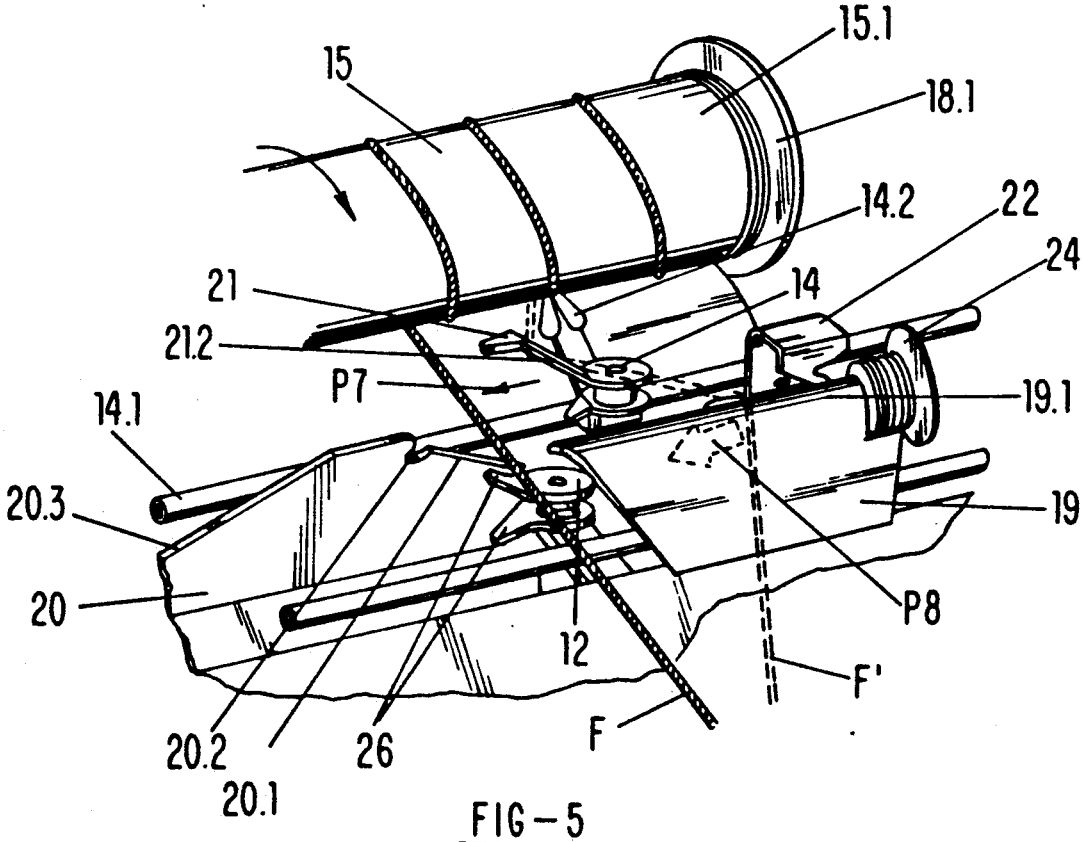

The threading begins when the device is in the operational stat e indicated in FIGS. 3 and 4. The thread which is indicated with reference numeral F', respectively, F in FIGS. 3 and 4 is guided through the thread depressor 25 and via the thread guide roller 24 to the first end 15.1 of the spool body 15 and is there clamped between the centering disk 18.1 and the spool body 15. This may be achieved, for example, by manually displacing the spool body 15 against the force of the spring of the frame of the spool holder whereby a gap between the centering disk 18.1 and the first end 15.1 of the spool body 15 results. Into this gap the end FE of the thread is inserted and after release of the spool body 15 is clamped under the force of the spring. By engaging the frictional drive roller 17 with the spool body 15, the thread F is advanced. The piece of the thread which is guided via the thread guide roller 24 is advanced to the left end (see FIGS. 3 and 4) of the thread guide roller 24 due to the threaded portion 24.1. Due to this movement the first end 15.1 of the spool body 15 is provided with a thread reserve. At the left end of the thread guide roller 24 the thread is transferred to the outermost end 19.11 of the curved upper edge 19.1 of the thread guide plate 19 where, in the direction of arrow P5 (FIG. 4), it slides along the descending curved upper edge 19.1 to the inner most end 19.12 of the curved upper edge 19.1. After the thread has slid down the curved upper edge 19.1, the device is in a state as represented in FIG. 5.

However, it is not a necessary requirement that the thread freely slides along the curved upper edge 19.1. As indicated in a dashed line in the drawing, the first follower 21 may engage the thread F' during its movement along the curved upper edge 19.1 and due to its movement in the direction of arrow P7 may force the thread in the direction of arrow P8 (direction of the traversing movement). In any case, the thread will be engaged by the first follower 21 when in the position indicated as a solid line in FIG. 5 whereby it slides along the sliding edge of the bottom side 21.2 into the second deflecting guide roller 14.

Figure 6:
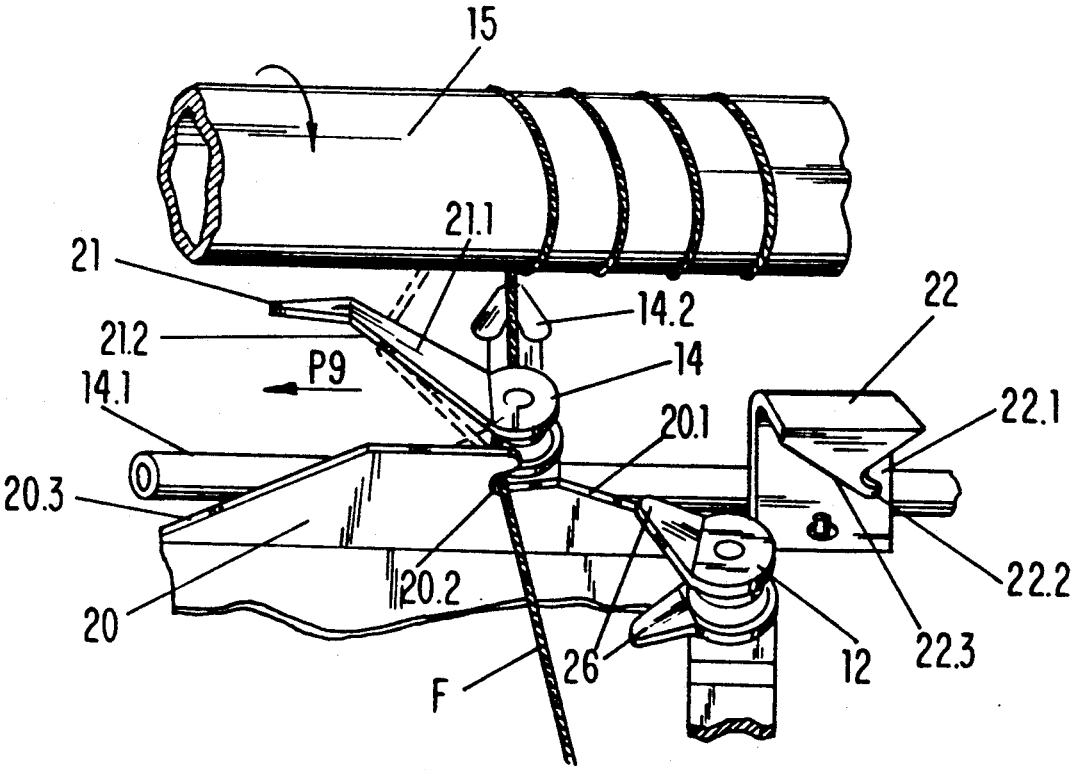
Figure 7:
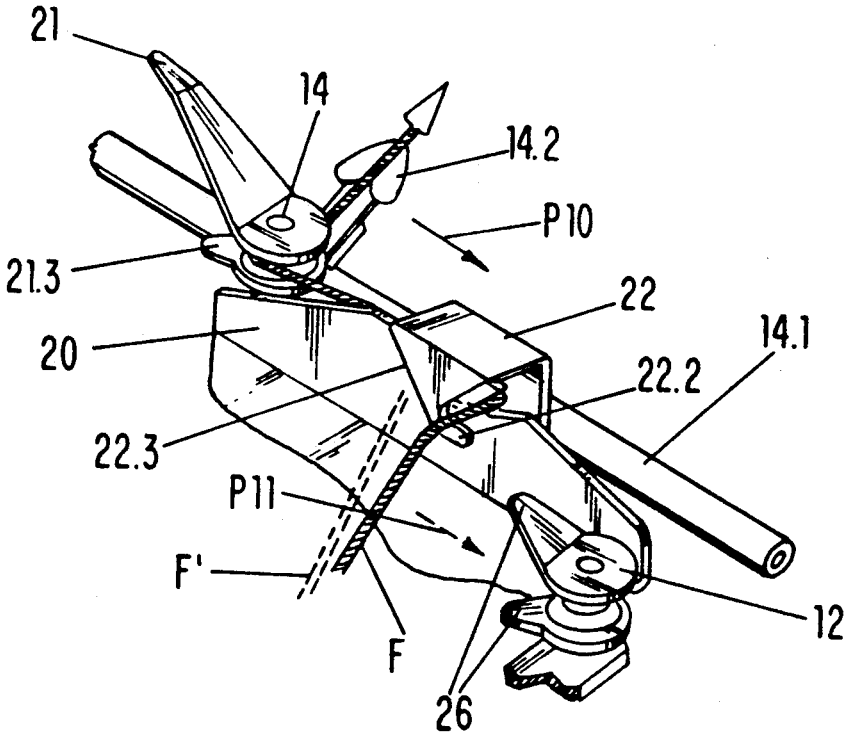

The thread is then forced by the second deflecting guide roller 14 in an upward direction along the thread guide edge 20.1 of the guiding plate 20 until it reaches the thread catch 20.2. This state is represented in FIG. 6.

The second deflecting guide roller 14 with the first follower 21 continues its movement in the same direction of arrow P9 (FIG. 6) until it reaches the end position of its traversing path whereby the second follower 22 follows this movement. When passing the thread catch 20.2 the hook 22.2 traverses the thread F' with its sliding edge 22.3. This is indicated in a dashed line in FIG. 7. During the return of the second deflecting guide roller 14 in the direction of arrow P10 and the corresponding movement of the second follower 22, the hook 22.2 engages from below the thread F and conveys it in the direction of arrow P11 until it reaches the first deflecting guide roller 12. This process is supported by the thread catching device 26 that is in the form of an open bill and is connected to the deflecting guide roller 12.

Figure 2A:
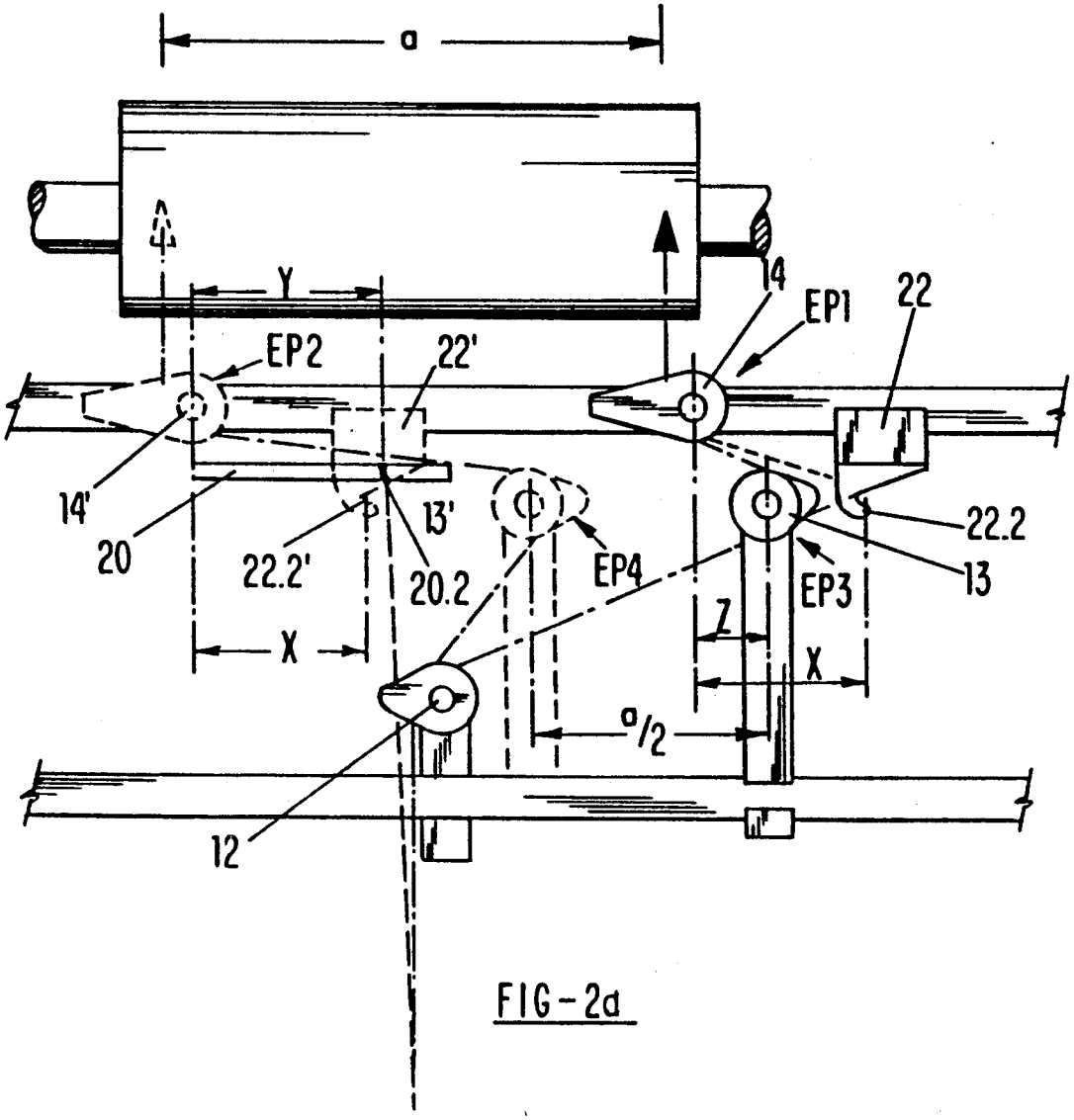
FIG. 2*a* shows the movements of the main thread traversing guide and the compensating thread traversing guide in connection with a threading device according to FIGS. 3 to 9.
Figure 8:
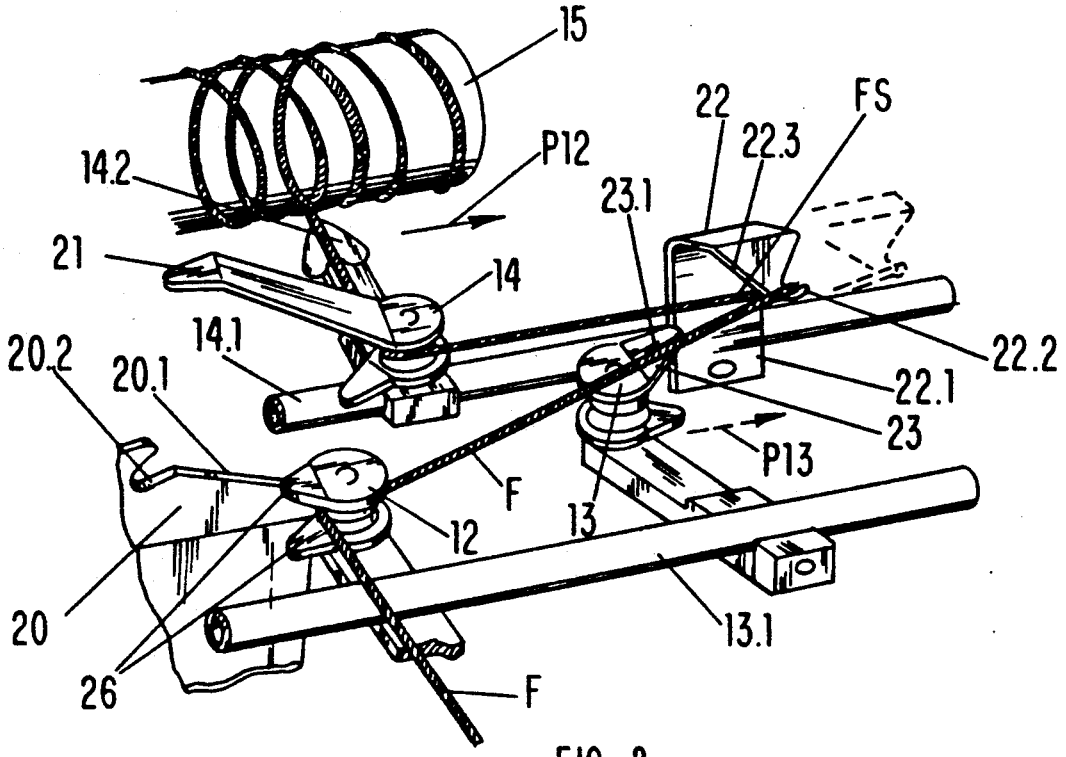

The further advancement of the movement may be taken from FIG. 8. The thread F is now guided about the first deflecting guide roller 12, the hook 22.2, and the second deflecting guide roller 14. The thread loop which has been transported by the hook 22.2 passes the third follower 23 connected to the deflecting guide roller 13. The second follower as well as the third deflecting guide roller 13 move in the direction of arrows P12 and P13 toward their respective end positions see (FIG. 2*a*), as indicated in a dashed line in FIG. 8.

Figure 9:
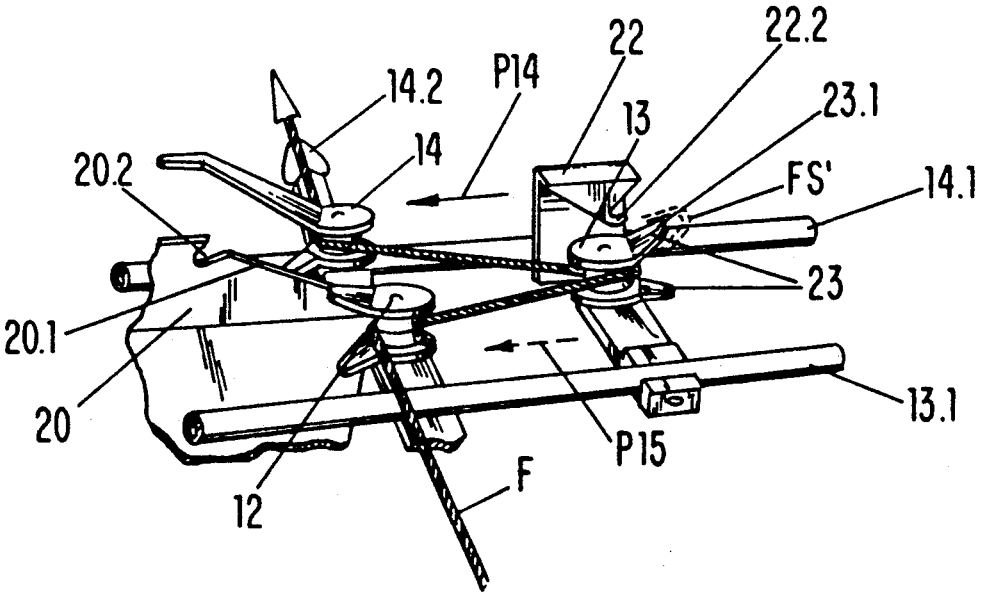

FIG. 9 represents the situation during the return of the second follower 22 in direction of arrow P14. The thread loop FS is removed from the hook 22.2 by the third follower 23 or finger 23.1 in the manner indicated by reference numeral FS'. Under the effect of the thread catching device 23 it is threaded into the third deflecting guide roller 13. This final position is indicated by a solid line in FIG. 9. The third deflecting roller 13 is moved further in direction of arrow P15.

After the completion of the threading into the third deflecting guide roller 13 the threading process is complete. The thread F extends now, as indicated in FIG. 9 exactly in the same manner as previously shown in FIG. 3.

As the course of the threading process indicates, the aforementioned rule for the distance of the second follower 22 relative to the second deflecting guide roller 14 results from the fact that, on the one hand, in the end position EP2 of the second deflecting guide roller 14 (FIG. 2*a*) the hook 22.2 must have passed the thread catch 20.2 (FIG. 7) and, on the other hand, in the end positions EP1, respectively, EP3 of the second deflecting guide roller 14 and the third deflecting guide roller 13, the hook 22.2 must have passed the third deflecting guide roller 13 to a point that during the return stroke the thread loop can be transferred to the third follower 23, see FIGS. 8 and 9.

The above described threading device not only allows the introduction of a new thread onto the empty spool body, but also provides for a reinsertion after the thread has ruptured. It is then also possible to insert the thread at the second end 15.2 of the spool body 15 or in the vicinity of this second end and to start the automatic threading process which then takes place with the aid of the second thread guide edge 20.3. As is not individually represented in the drawings, but can be taken for example from FIGS. 3 and 5 through 7, a thread inserted at the second end 15.2 is first directly engaged by the main thread traversing guide 14.2 and is guided in the direction of the first end 15.1 of the spool body 15. During the course of the movement the thread is conveyed past the second thread guide edge 20.3 until it reaches the thread catch 20.2. From this thread catch 20.2 the thread is removed by the main thread traversing guide 14.2 and guided along the first thread guide edge 20.1 whereby the thread cannot pass the first thread deflecting guide roller 12. During the following traversing stroke which is performed from the first end 15.1 to the second end 15.2 of the spool body 15 the aforedescribed automatic threading process takes place.

Figure 10:
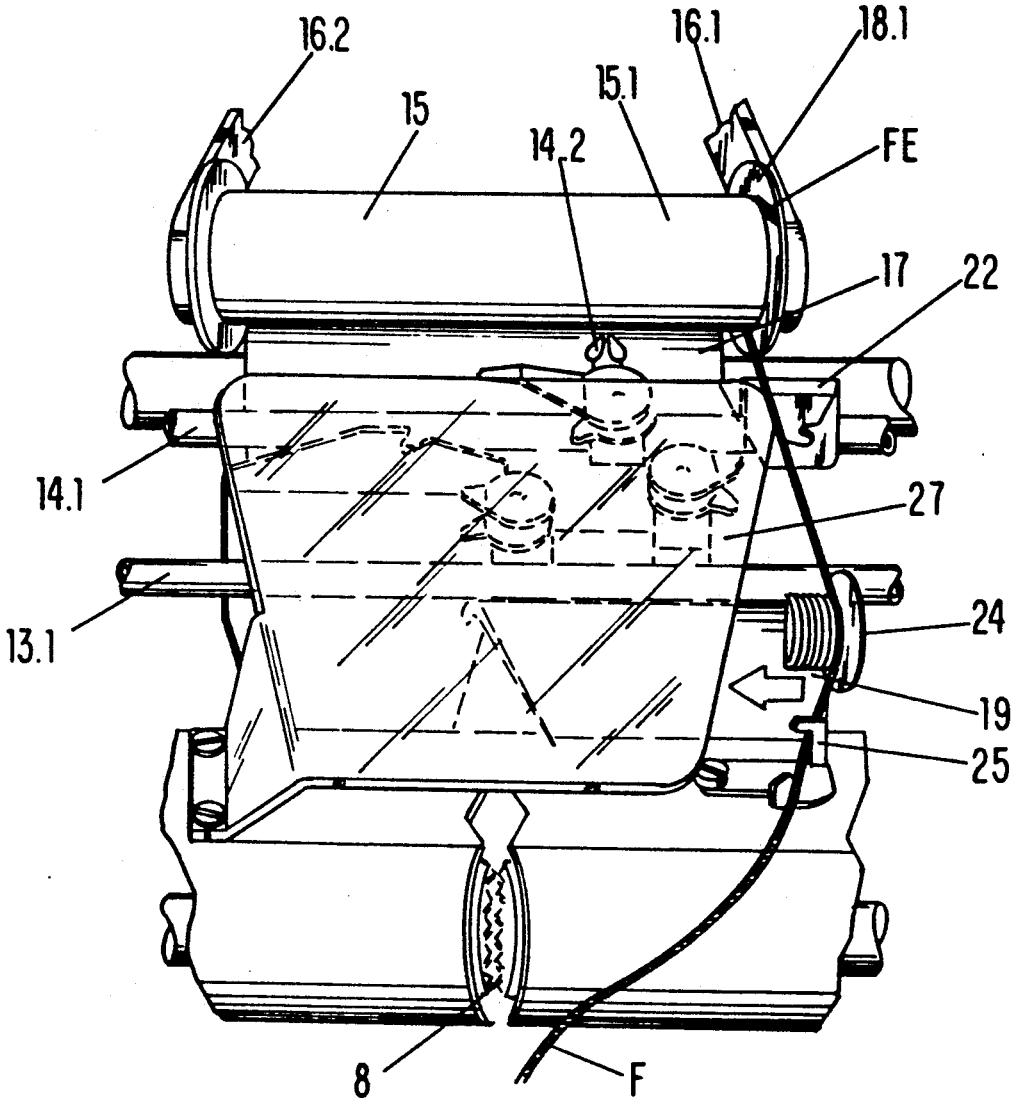
FIG. 10 shows a device according to FIG. 3 with a cover plate.

From the described functioning of the device it is obvious that during the threading process a number of components is closely arranged to one another and is moved relative to one another. It is therefore expedient for safety reasons to provide a cover plate 27, as represented in FIG. 10, for covering the area of the threading device. This cover plate 27 is preferably located between the thread feed roller 8 and the main thread traversing guide 14.2 and is designed such that it is above the deflecting guide rollers 12, 13, 14, but leaves uncovered the area of the thread depressor 25 and the thread guide roller 24 so that the aforementioned step of guiding the thread under the thread depressor 25 and over the thread guide roller 24 and the step of clamping the thread end between the centering disks 18.1 and the end 15.1 of the spool body 15 can be performed. Upon starting the proper threading process the thread will be guided under the cover plate 27. The cover plate 27 may be made of transparent material so that a visual supervision of the threading process is possible.

The present invention is, of course, in no way restricted to the specific disclosure of the specification and drawings, but also encompasses any modifications within the scope of the appended claims.

What we claim is:

1. A device for winding a thread onto a spool body; said device comprising:

a spool holder for the spool body comprising a device for clamping the end of the thread to a first end of the spool body;

a drive unit for driving the spool body;

a thread feeding device coordinated with the spool body;

a stationary first thread deflecting device connected downstream of said thread feeding device and located opposite the longitudinal center of the spool body;

a main thread traversing guide comprising a second thread deflecting device, said second thread deflecting device positioned between said first thread deflecting device and the spool body, said main thread traversing guide reciprocating along a first traversing path parallel to a center axis of the spool body with a predetermined first traversing stroke corresponding essentially to the length of the spool body;

a compensating thread traversing guide in the form of a third thread deflecting device, positioned between said first thread deflecting device and said main thread traversing guide, said third thread deflecting device reciprocating along a second traversing path parallel to said first traversing path of said main thread traversing guide, said second traversing path located between the longitudinal center of the spool body and said first end of the spool body, said second traversing path having a predetermined second traversing stroke corresponding essentially to half said first traversing stroke, wherein said first, said second, and said third thread deflecting devices are essentially arranged in a common plane, and wherein, for winding the thread onto the spool body, the thread is guided from said thread feeding device via said first, said second and said third thread deflecting devices and via said main thread traversing guide to the spool body;

a thread guide plate connected between said thread feeding device and said first thread deflecting device, said thread guide plate having a curved upper edge on which the thread glides during an initial threading step said curved upper edge having a first and a second end and extending parallel to said first traversing path of said main thread traversing guide at an elevation above said first thread deflecting device, with said first end positioned opposite said device for clamping the thread and with said second end positioned opposite said first thread deflecting device;

a thread guide edge connected between said second and said third thread deflecting devices and extending parallel to a plane of said first traversing path of said main thread traversing guide, said thread guide edge ascending from a point below said second end of said curved upper edge in a direction toward the second end of the spool body and ending in a recessed thread catch, said thread catch positioned between said first thread deflecting device and the end position of said first traversing path in the area of said second end of said spool body;

a first follower connected to said second thread deflecting device comprised of a finger extending in the direction of said first traversing path and pointing toward said second end of the spool body, said first follower having sliding edges for the thread at the top side and at the bottom side of said first follower that extend upwardly in the direction of the free end of said first follower, said sliding edge at the bottom side of said follower having a transition into said second thread deflecting device;

a second follower connected to said second thread deflecting device said second follower facing said first end of said spool body, said second follower comprising a holder that during its course of movement traverses said thread guide edge and has a hook that, in the direction of movement, is open toward said first end of the spool body, wherein the distance between said hook and said second thread deflecting device is smaller than the distance between said thread catch and said end position of said first traversing path in the area of said second end of said spool body and is greater than the distance between the end position of said first traversing path in the area of said first end of the spool body and the end position of said second traversing path in the area of said first end of the spool body; and a third follower connected to said third thread deflecting device, said third follower in the form of a finger extending toward said first end of the spool body in the direction of said second traversing path, said third follower having a sliding edge for the thread at the top side and at the bottom side thereof that extend upwardly in the direction of the free end of said third follower, said sliding edge at the bottom side having a transition into said third thread deflecting device, wherein said free end of said third follower is positioned essentially in the plane of movement of said hook.

2. A device according to claim 1, further comprising a thread guiding roller connected to said first and of said curved upper edge of said thread guide plate, said thread guiding roller having a threaded outer mantle surface.

3. A device according to claim 2, further comprising a thread depressor connected in front of said thread guide plate when viewed in the direction of movement of the thread.

4. A device according to claim 3, further comprising a cover plate for covering the area between said thread feeding device and said main thread traversing guide above said first, said second, and said third thread deflecting devices, with the area of said thread guiding roller and said thread depressor remaining uncovered.

5. A device according to claim 4 wherein said cover plate is made of transparent material.

6. A device according to clâim 2, wherein said curved upper edge of said thread guide plate is downwardly slanted from said thread guiding roller to said second end of said curved upper edge.

7. A device according to claim 1, wherein:

said spool holder comprises a springloaded frame and rotatably supported centering disks;

a first one of said centering disks is said device for clamping the end of the thread, said first centering disk pivotably supported at said frame;

the spool body is held in an initial position in said frame by the spring load and is slidable against said force of the spring load so that a gap results between an end face of the spool body facing said first centering disk and said first centering disk; and for clamping the end of the thread, the end of the thread is placed into said gap and the spool body is moved back into said initial position so that the end of the thread is clamped between the spool body and said centering disk.

8. A device according to claim 1, wherein at least one of said first, said second, and said third thread deflecting devices are deflecting guide rollers.

9. A device according to claim 8, wherein at least one of said deflecting guide rollers has a thread catching device shaped like an open bill.

10. A device according to claim 9, wherein said first follower and said third follower are components of said thread catching devices.

11. A device according to claim 1, further comprising a guiding plate arranged in a plane parallel to the plane of movement of said main thread traversing guide, with an upper edge of said guiding plate forming said thread guide edge and said thread catch.

12. A device according to claim 11, further comprising a guide rod having connected thereto said main thread traversing guide, and wherein said holder of said second follower is an essentially U-shaped plate open in a downward direction, with the plane of said guiding plate positioned between the legs of said U-shaped plate and with one of the legs of said U-shaped plate connected to said guide rod, with the other leg of said U-shaped plate, at a side thereof facing said second thread deflecting device, having a recessed sliding edge and, at a side thereof facing away from said second thread deflecting device, having said hook at its lower end.

* * * * *